United States Patent [19]

Pinson

[11] Patent Number: 4,604,592

[45] Date of Patent: Aug. 5, 1986

[54] ELECTRICALLY CONTROLLED RADIO FREQUENCY TUNER

[75] Inventor: George T. Pinson, Huntsville, Ala.

[73] Assignee: The Boeing Company, Seattle, Wash.

[21] Appl. No.: 602,207

[22] Filed: Apr. 19, 1984

[51] Int. Cl.[4] ..... H01P 1/20; H01P 1/23

[52] U.S. Cl. ..... 333/24.1; 333/81 B; 333/253; 333/258

[58] Field of Search ..... 333/24.1, 24.2, 81 B, 333/253, 258, 263; 334/4

[56] References Cited

U.S. PATENT DOCUMENTS 2,532,157 11/1950 Evans ..... 333/253 X
2,629,079 2/1953 Miller et al. ..... 333/81 B X
2,944,220 7/1960 Tellegen ..... 333/24.1 X

*Primary Examiner*—Paul Gensler
*Attorney, Agent, or Firm*—Edwin H. Crabtree

[57] ABSTRACT

An electrically controlled radio frequency tuner used in conjunction with an antenna. The antenna used both as a transmitter and a receiver. The tuner eliminating waveform reflection and circulator feedthrough of transmitted signals which heretofore reflected back into the receiver creating a noise threshold that decreased the sensitivity of the receiver.

8 Claims, 12 Drawing Figures

ELECTRICALLY CONTROLLED RADIO FREQUENCY TUNER

BACKGROUND OF THE INVENTION

This invention relates to a radio frequency tuner and more particularly but not by way of limitation to an electrically controlled radio frequency tuner using a signal waveguide housing having a ferromagnetic fluid therein which is controlled by a plurality of magnets attached to the exterior of the waveguide housing.

Heretofore, there have been various types of devices used for magnetically controlling ferromagnetic fluids in waveguide sections. These devices are described in the following U.S. patents. U.S. Pat. No. 3,956,938 to Carrico, U.S. Pat. No. 3,001,154 to Reggia, U.S. Pat. No. 2,532,157 to Evans, U.S. Pat. No. 2,798,207 to Reggia, U.S. Pat. No. 4,188,594 to Bongianni and a 1949 Article to Miller. None of these prior art devices specifically use controlled electromagnets for partially blocking or blocking the cavity of the waveguide housing.

Heretofore, reflections and circulator feedthrough in a radio frequency system using a common antenna for both the transmitter and receiver caused a part of the transmitted signal to be reflected back into the receiver. This unwanted signal effectively created a noise threshold which decreased the sensitivity of the receiver. Current methods used in tuning a transceiver are subject to error, are labor intensive and are subject to shift as a result of a particular environment. The subject invention provides the unique combination of structure and advantages of eliminating signal feedback, thereby improving the sensitivity of the receiver.

SUMMARY OF THE INVENTION

The subject invention provides a means to tune a radio frequency system by reducing signal feedback and thereby improving the sensitivity of the receiver. This feedback raises the noise threshold which decreases the sensitivity of the receiver.

The radio frequency tuner provides a means which permits the operator to adjust the energy reflected accurately allowing the operator to control partial or full obstruction of the waveguide. Also, through the use of the frequency tuner a phase shift in the reflected wave can be obtained.

Also, the electrically controlled radio frequency tuner can be used for automatic or remote tuning along with totally autonomous operation for aircraft and missile applications.

The electrically controlled radio frequency tuner for eliminating a transmitted signal waveform reflection and circulator feedback includes an elongated waveguide housing having a cavity along the length thereof. A first and second magnet are attached to the housing and are disposed in a spaced relationship along the length of the housing and mounted on the exterior of the housing. A ferromagnetic fluid is disposed inside the cavity of the housing and held therein by the first and second magnets. Third and fourth magnets are attached to the exterior of the housing and disposed adjacent the first and second magnets and when energized, provide alignment of the ferromagnetic fluid inside the cavity for partially or fully blocking the cavity and control of the waveform reflections and feedthrough of the signal.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
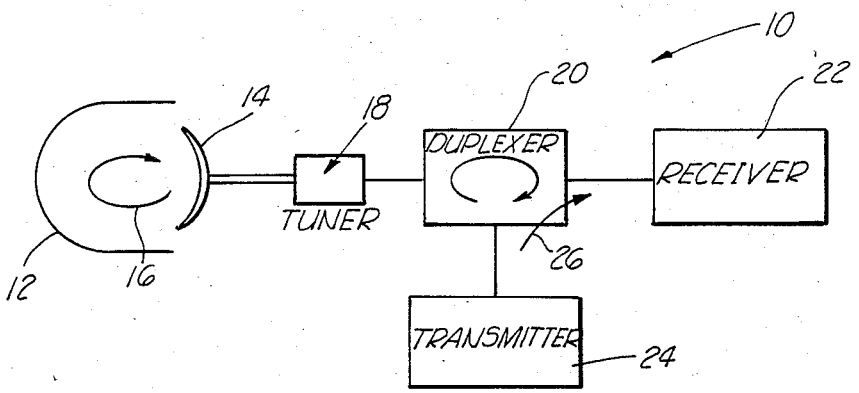
FIG. 1 PRIOR ART
FIG. 1 illustrates a prior art radio frequency tuning system.

In FIG. 1 a prior art radio frequency tuning system is shown and designated by general reference numeral 10. The tuning system 10 includes a radome 12 disposed adjacent to an antenna 14 which is both a receiver and a transmitter. An arrow 16 illustrates undesirable feedback to the antenna 14. The antenna 14 is attached to a tuner 18. The tuner 18, in turn, is attached to a duplexer circulator 20 which in turn is connected to a receiver system 22 and a transmitter system 24. Arrow 26 illustrates undesired leakage from the transmitter system 24 through the duplexer 20 to the receiver system 22.

Figure 2:
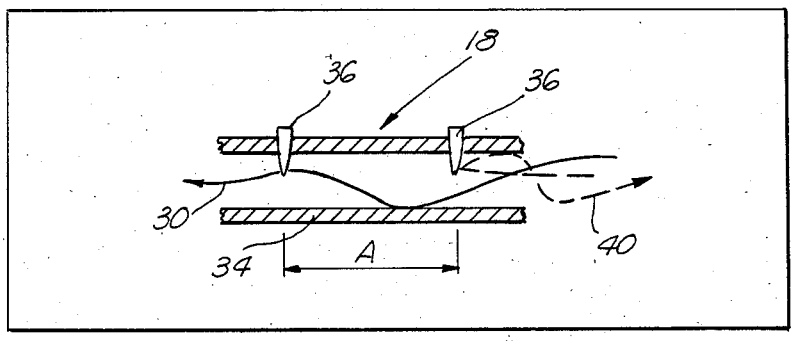
FIG. 2 PRIOR ART
FIG. 2 illustrates a typical fractional wavelength with reflected signal.

In FIG. 2 a transmitted signal indicated by arrow 30 is shown received through a waveguide housing 34 having tuning stubs 36. The amount of metal of the tuning stubs 36 inserted into the waveguide housing 34 is changed which in turn changes the radio frequency energy of the reflected signal 40. The radio frequency energy 40 reflected back is shown in dotted lines. By the use of the two tuning stubs 36 separated by a fractional wavelength indicated by dimension A, both the phase and amplitude of the reflected signal 40 can be varied such that a deliberate signal exactly cancels out an inadvertently reflected signal.

Undesired feedback or leakage can occur as a result of reflections off of the radome 12 and the antenna 14, and as a result of direct leakage of the transmitted signal 30 through the circulator 20. In a continuous wave system, the receiver 22 must attempt to distinguish this feedback from the signal reflected from the actual target. The unwanted signal can be higher than the target signal returned at even moderate ranges, thereby greatly reducing the effective range of the radio frequency system 10.

The placement of the radio frequency tuner 18 in the system 10 permits the operator to adjust the energy reflected by the tuning stubs 36. If any changes in the cavity dimension of the housing 34 occurs due to environment effects or if vibration or shock cause the tuning stubs 36 to be moved, the system 10 can be placed out-of-tune. If detuning occurs, the system 10 may be rendered totally ineffectual until it can be returned. It is obvious that if the detuned system is used on a missile or some critical application where humans are unable to retune the system 10, loss of the missile or system can occur.

Figure 3:
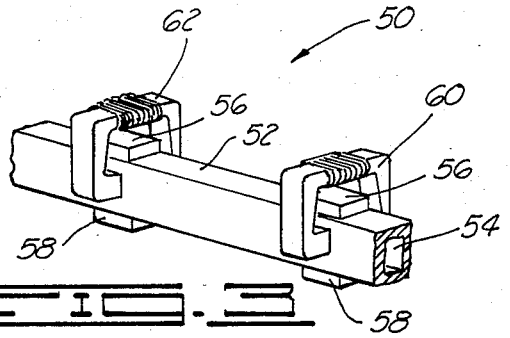
FIG. 3 illustrates the electrically controlled radio frequency tuner.

In FIG. 3 the subject electrically controlled radio frequency tuner for eliminating a transmitted signal reflection and circulator feedthrough is illustrated and designated by general reference numeral 50. The tuner 50 includes an elongated waveguide housing 52 having a waveguide channel cavity 54 along the length thereof. A pair of first magnets 56 and second magnets 58 are attached to the housing 52 and disposed in a spaced relationship along the length of the housing 52. The magnets 56 and 58 may be permanent magnets or any other similar type of magnet.

The spaced relationship between the magnets 56 and 58 may vary along the length of the housing 52 for different wave lengths and applications. Also, the magnets 56 and 58 may be secured to the housing 52 by various attachment means. Disposed between the first magnets 56 and second magnets 58 are a third electromagnet 60 and a fourth electromagnet 62. The poles of the electromagnets 60 and 62 may be placed at approximately 90° between the permanent magnets 56 and 58 but it can also be appreciated that they may be placed at various angles between the two magnets 56 and 58 and accomplish similar results.

Figure 4:
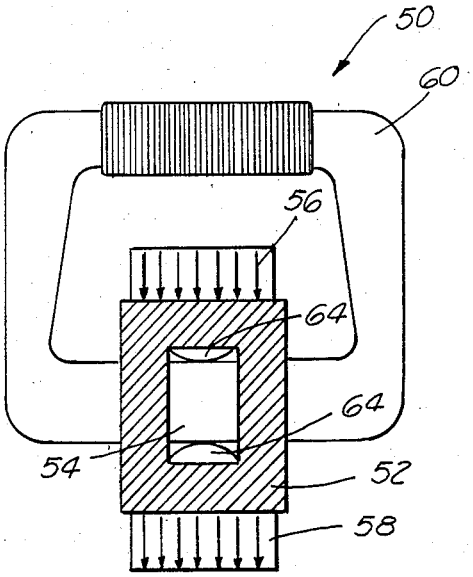
FIGS. 4 and 5 illustrate an end sectional view and side sectional view of the tuner.
Figure 5:
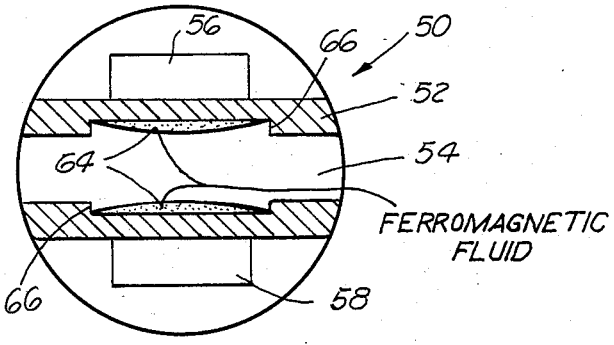

Shown in FIGS. 4 and 5 is a ferromagnetic fluid 64 placed inside the cavity 54 and held in place by the magnetic force of the first magnets 56 and second magnets 58. While a ferromagnetic fluid 64 is discussed, other types of ferric oxides on magnetic tape and similar ferrous material could be used equally well.

In operation of the tuner 50, the energizing of the third and fourth electromagnets 60 and 62 creates a magnetic field between the magnetic poles. The ferromagnetic fluid 64 is attracted by the magnetic field and aligns itself along the magnetic lines of force. This results in a partial or full obstruction of the waveguide 52.

Figure 6:
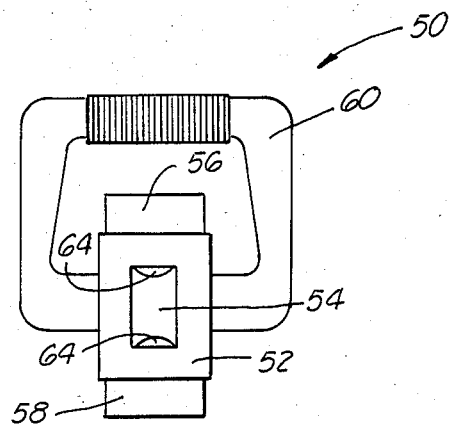
FIG. 6 illustrates an end view of the tuner with electromagnets turned off.
Figure 7:
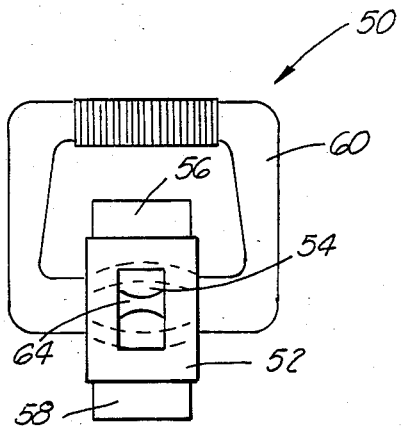
FIGS. 7 and 8 illustrate the ferromagnetic fluid alignment inside the waveguide housing.

With no current supplied to the electromagnet 60 as shown in FIG. 6, the fluid 64 is held in position by the permanent magnets 56 and 58. If only a small amount of fluid 64 is used and the field generated by the electromagnet 60 is larger than that of permanent magnets, a column of ferromagnetic fluid partially fills the cross section of the waveguide cavity 54 as shown in FIG. 7. This partial filling reflects wave signal energy back down the cavity 54. By properly adjusting the amount of the ferromagnetic fluid 64 in the cavity 54 and adjusting the current to the electromagnets 60 and 62, the desired tuning range can be achieved, ranging from full blocking to very small adjustments in the reflected signal. To minimize the radio frequency loss through the cavity 54, undercutting or providing a channel 66 in the cavity 54 as shown in FIG. 5 allows the ferromagnetic fluid 64 to be held in place prior to partial or full blockage of the cavity 54.

Figure 8:
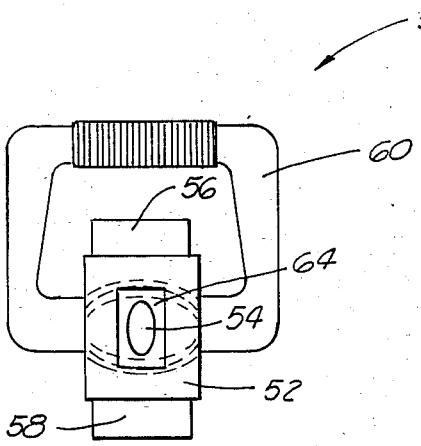

FIG. 8 illustrates the electromagnet 60 energized with excessive fluid 64 providing increased blockage when compared to blockage shown in FIG. 7. The dash lines represent polar magnetic forces when current is applied to electromagnets 60 and 62.

Figure 9:
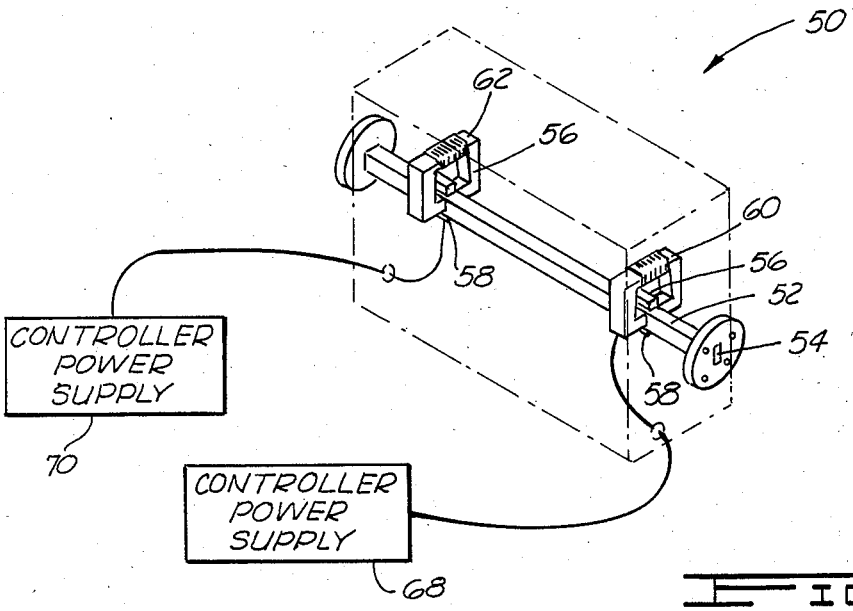
FIG. 9 illustrates an alternate electrically controlled radio frequency tuner.

In FIG. 9 an alternate application of the tuner 50 is shown providing separate controllable power supplies 68 and 70 to the electromagnets 60 and 62. The separate power supplies 68 and 70 are required to control the power and the phase of the reflected signal.

Figure 10:
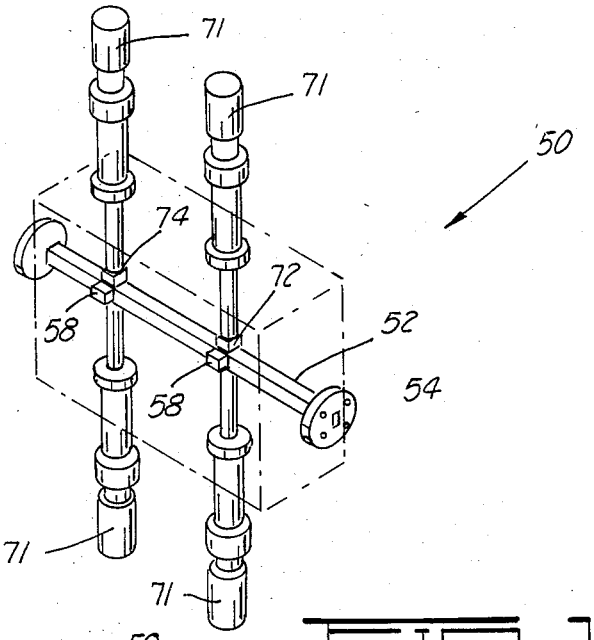
FIG. 10 illustrates an adjustable controlled radio frequency tuner.

With the use of an accurate mechanical adjusting system, the electromagnets 60 and 62 can be replaced by permanent magnets 72 and 74 as shown in FIG. 10. This means of adjustment represents a separate embodiment and, for example, uses vernier adjustments 71 allowing the permanent magnets 72 and 74, which are movable along the length of the housing 52, to be adjusted accordingly.

Figure 11:
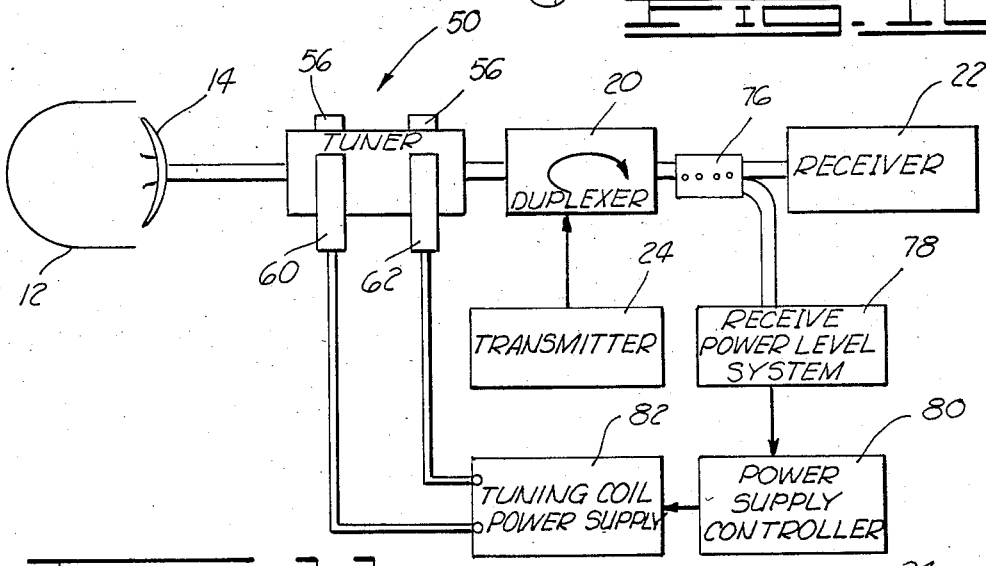
FIGS. 11 and 12 illustrate a typical autonomous radio frequency tuner and an alternate autonomous radio frequency tuner.

In FIG. 11, the received power level is monitored and the power to each of the multiple electromagnets 60 and 62 is changed in accordance with a predefined sequence to null out the undesired leakage through the duplexer 20 and return it through the antenna 14. This embodiment includes a coupler 76 between the duplexer 20 and the receiver system 22. The coupler 76 is connected in series to a receive power level system 78, power supply controller 80 and a multiple tuning coil power supply 82. The power supply 82 is connected to the electromagnets 60 and 62.

Figure 12:
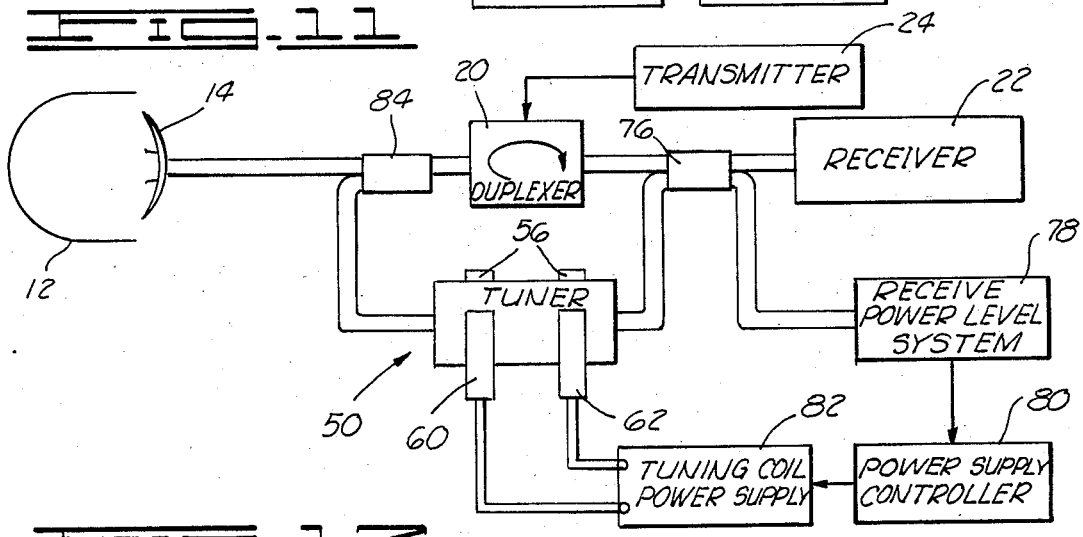

An alternate embodiment is shown in FIG. 12 wherein the tuner 50 in the circuit is in a different position than in FIG. 11. The tuner arrangement in FIG. 12 includes an additional coupler 84 with both couplers 76 and 84 connected to the tuner 50. It should be noted, that although there are two alternate embodiments shown in FIGS. 11 and 12 for operating the electrically controlled tuner 50, a number of different types of embodiments can be used without departing from the scope of the electrically controlled tuner 50 as described above. Also, it should be noted through the use of both the movable permanent magnets and electromagnets, remote tuning can be provided for totally autonomous operation for use in a missile payload, other aircraft applications and the like.

Changes may be made in the construction and arrangement of the parts or elements of the embodiments as described herein without departing from the spirit or scope of the invention defined in the following claims.

What is claimed is:

1. An electrically controlled radio frequency tuner for eliminating a transmitted signal reflection and circulator feedthrough, the tuner comprising:

an elongated waveguide housing having a cavity along the length thereof;

a pair of first and second magnets attached to the exterior of the housing and disposed in a spaced relationship to each other and along the length of the housing;

ferromagnetic fluid disposed inside the cavity of the housing and held therein by the magnetic forces of the first and second magnets; and a third and fourth magnet attached to the exterior of the housing and adjacent the first and second magnets, the third and fourth magnets, when energized, aligning the ferromagnetic fluid inside the cavity for partially blocking to fully blocking the cavity and thereby setting up a measured reflection for cancelling the undesired reflection and circulator feedthrough.

2. The tuner as described in claim 1 wherein the first and second magnets are permanent magnets.

3. The tuner as described in claim 1 wherein the third and fourth magnets are electromagnets.

4. The tuner as described in claim 3 wherein the third and fourth electromagnets are provided with separate power supplies for applying controlled power thereto.

5. The tuner as described in claim 1 wherein the cavity includes channels therein, the channels adjacent the first and second magnets and used for receiving the ferromagnetic fluid therein.

6. The tuner as described in claim 1 wherein the third and fourth magnets are movable along the length of the waveguide housing.

7. An electrically controlled radio frequency tuner for eliminating a transmitted signal reflection and circulator feed through, the tuner comprising:

an elongated waveguide housing having a cavity along the length thereof;

a pair of first and second permanent magnets attached to the exterior of the housing and disposed in a spaced relationship to each other and along the length of the housing;

ferromagnetic fluid disposed inside the cavity of the housing and held therein by the magnetic force of the first and second magnets;

third and fourth electromagnets attached to the exterior of the housing and disposed adjacent the first and second magnets; and separate power supplies to the third and fourth magnets for applying electrical energy to the electromagnets for controlling the magnetic force applied to the ferromagnetic fluid inside the cavity for partially blocking to fully blocking the cavity and thereby setting a measured reflection for cancelling the undesired reflection and circulator feed through.

8. The tuner as described in claim 7 wherein the cavity includes channels therein, the channels adjacent the first and second magnets and used for receiving the ferromagnetic fluid therein.

* * * * *